United States Patent [19]

McMillan

[11] 4,320,636

[45] Mar. 23, 1982

[54] MECHANISM FOR ORBITING WASHER

[75] Inventor: Stephen L. McMillan, Louisville, Ky.

[73] Assignee: General Electric Company, Louisville, Ky.

[21] Appl. No.: 186,807

[22] Filed: Sep. 12, 1980

[51] Int. Cl.[3] ..... D06F 23/00

[52] U.S. Cl. ..... 68/23 R

[58] Field of Search ..... 68/23 R, 171–174

[56] References Cited

U.S. PATENT DOCUMENTS 2,854,297 9/1958 Scott et al. ..... 308/145

2,948,128 8/1960 Smith ..... 68/133 X

FOREIGN PATENT DOCUMENTS 151477 5/1953 Australia ..... 68/231 R

*Primary Examiner*—Philip R. Coe

*Attorney, Agent, or Firm*—Radford M. Reams

[57] ABSTRACT

A washing machine includes a fabric-receiving basket driven through a transmission arranged so that when the drive shaft is driven in one direction in the washing or rinsing mode of operation of the washing machine, the basket is caused to orbit about an axis displaced from the axis of the basket. The basket is held against rotation about its axis during this mode of operation. When the drive shaft is driven in the opposite direction during the spin mode of operation, the axis of the basket is positioned in line with the axis of the input shaft and the basket is free to rotate about its own axis. The input shaft of the transmission is provided with a helical groove at the lower end and a drive pulley is mounted for engagement with the helical groove. A brake housing is supported from the stationary tub of the washing machine. A spring-biased brake shoe is mounted in a position to engage the brake housing for preventing rotation of the basket about its axis when the basket is following the orbital path. In the spin mode, rotation of the pulley causes the pulley to ride up the helical groove, lifting the brake shoe out of engagement with the housing and permitting rotation of the basket about its axis.

11 Claims, 4 Drawing Figures

MECHANISM FOR ORBITING WASHER

BACKGROUND OF THE INVENTION

1. Field of the Invention

This invention relates to washing machines for washing fabrics, such as clothes, and more particularly to such machines having an orbital motion of the fabric receptacle during the washing and rinsing portions of the cycle of operation of the washing machine.

2. Description of the Prior Art

Conventional clothes washing machines of the vertical-axis, agitator type are usually rather large and complex. In such machines, there is generally provided a cabinet enclosing a water-retaining tube in which is disposed an inner fabric-receiving receptacle or basket. An agitator is mounted within the basket. The agitator and basket are coupled to a suitable power transmission driven by an electric motor. The transmission converts the high speed of the motor to a speed appropriate for centrifugal extraction of water from the fabrics in the basket and to a slower oscillatory motion of the agitator during the washing cycle. Such machines usually include a water pump for recirculating water within the machine and a filter for separating out the lint and other particles from the recirculated water. Inherently, such machines use large amounts of water. Also there is a high energy interface between the clothes being washed and the oscillating agitator. Many such machines have vibration and traveling problems resulting from imbalances in the machines during the centrifugal water extraction or spinning operation. Such machines have frequently required complex suspension systems, including counterweights, and often the basket is provided with an annular balance ring in a further effort to alleviate the vibration and traveling problems.

Various alternatives have been proposed to simplify washing machines and to eliminate or reduce some of the problems referred to above. One such alternative arrangement is that illustrated and described in the copending application of John Bochan, Ser. No. 142,949, filed Apr. 23, 1980, which is assigned to the assignee of the present invention and which is a continuation-in-part of application Ser. No. 039,406, filed May 15, 1979. The washing machine illustrated and described in the aforementioned Bochan application is of the vertical-axis type wherein the fabric receptacle or basket is driven during the washing and rinsing operations in such manner that the basket moves in an orbital path. The basket is restrained from rotating about its axis while being orbited. In the washing machine of the Bochan application, after the washing or rinsing operation has been completed, provision is made for aligning the basket axis with the axis about which it was orbiting, and the basket is then rotated about this axis to centrifugally extract water from the fabric load.

In the structure of the Bochan application it is necessary that the basket be free to rotate about its axis during the centrifugal extraction or spinning operation and that it be prevented from rotating about its axis while orbiting during the washing or rinsing operation. The Bochan application discloses a mechanism for accomplishing this result. The present invention is directed to an improvement over the apparatus of the Bochan application with respect to the arrangement for preventing rotation of the basket about its axis in the orbiting mode and permitting free rotation of the basket about its axis in the spinning mode and with respect to the arrangement of a crank and eccentric in the transmission.

It is an object of this invention to provide a simplified arrangement for automatically preventing rotation of the fabric receptacle or basket about is axis during the washing or rinsing operation and permitting free rotation of the basket about its axis during the spinning or centrifugal extraction operation.

It is a further object of this invention to provide a braking apparatus and actuating means which is readily accessible.

SUMMARY OF THE INVENTION

In carrying out the invention, in one form thereof, there is provided a washing machine of the fresh-water, vertical-axis type including a vertical-axis receptacle or basket for receiving a load of fabrics to be washed. The basket is driven through a transmission arranged so that when the washing machine is in its washing mode of operation the basket is caused to orbit about an axis displaced from the axis of the basket, the basket during this mode of operation being held against rotation about its axis. When the washing machine is in the spin or extraction mode of operation the transmission causes the axis of the basket to be positioned in line with the axis of the input shaft and the basket rotates about its own axis. In accordance with this invention a simplified structure is provided for preventing rotation of the basket about its own axis when the basket is following an orbital path and for allowing the basket to move freely about its own axis when the washing machine is in the spin mode. The input shaft of the transmission is provided with a helical groove at the lower end and a drive pulley is mounted for engagement with the helical groove. The apparatus includes a brake housing that is supported from the stationary tub of the washing machine. A brake shoe is mounted on a spline in a position to be engageable with the brake housing for preventing rotation of the basket about its axis when the basket is following the orbital path. In the spin mode, rotation of the pulley causes the pulley to ride up the helical groove, lifting the brake shoe out of engagement with the housing and permitting rotation of the basket about its axis.

DETAILED DESCRIPTION OF THE PREFERRED EMBODIMENT

Figures 1, 4:
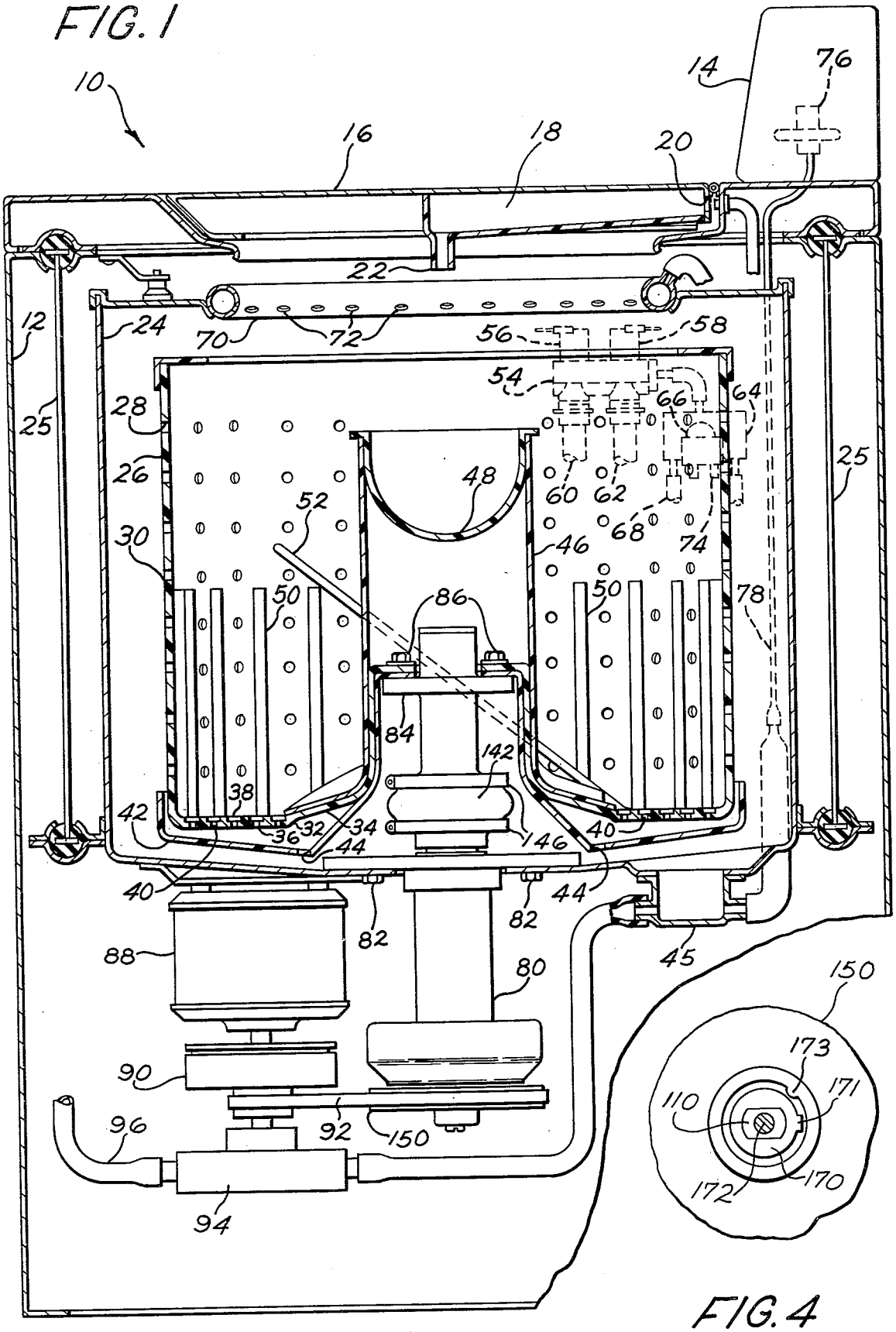
FIG. 1 is an elevation view, partly in section, of a washing machine incorporating an embodiment of this invention.
FIG. 4 is a view taken along the line 4—4 in FIG. 2.

Referring to FIG. 1, there is shown a washing machine 10 of the vertical-axis type which includes a cabinet 12. The cabinet includes a control panel 14 which is normally provided with a plurality of switches and controls employed by the user in the operation of the machine. In the top of the cabinet there is provided an access lid hinged for movement between the closed position shown in FIG. 1 and an open position permitting access to the interior of the washing machine. Lid 16 is provided with a water-receiving trough or compartment 18 having a fluid inlet aperture 20 and a discharge spout 22.

Within the cabinet is disposed an imperforate stationary tub or casing 24. The tub is suspendedly mounted in the cabinet 12 by means of three rods, two of which are shown at 25. Within the tub 24 there is disposed a basket or receptacle 26 for receiving fabric articles, such as clothing, to be washed. The basket 26 is intended to be of relatively light weight and may be molded, for example, from a plastic material, such as polypropylene. The basket 26 has a substantially vertical axis.

The basket is provided with a plurality of apertures 28 in its side wall 30 for discharge of water from the basket into the tub during the spin or water extraction operation. The basket has a bottom 32 which includes a downwardly and outwardly sloping portion 34 near the center thereof and a flat horizontal outer portion 36. The outer portion 36 includes a plurality of concentric grooves 38 in which soil particles may collect. Each of the grooves 38 has a plurality of apertures 40 extending through the bottom of the basket for carrying water and soil particles from the basket. The water and soil particles pass into a pan 42 disposed beneath the basket. Apertures 44 are provided in the pan for conveying the water and soil particles to the tub 24 and thence to a sump 45.

A centerpost 46 extends upwardly at the central portion of the basket. A container 48 for receiving detergent is mounted at the top end of the centerpost 46. From time to time detergent is discharged from the container 48 to the basket by water supplied through the spout 22.

The basket 26 includes a plurality of vertical, inwardly extending ribs 50 on the side wall thereof for impacting the fabrics comprising the fabric load to effect washing thereof. A plurality of inclinded ramps, one of which is shown at 52, are provided on the side wall for effecting toroidal movement of the fabrics in the basket.

The particular construction of the basket shown and described is not part of the present invention but is illustrated and described in the aforementioned copending application of John Bochan.

The washing machine shown in FIG. 1 is a freshwater, flow-through machine. It includes water supply means in the form of a solenoid-operated mixer valve 54 having solenoids 56 and 58 and coupled to sources of hot and cold water, such as household faucets, through hoses 60 and 62 respectively. The output of the mixer valve 54 is fed through a solenoid diverter assembly 64 which includes a solenoid-operated control valve 66. When the valve 66 is in one position all the water entering the diverter assembly 64 is directed through a hose 68 to fill tube 70 from which the water is discharged through apertures 72 onto fabrics in the basket 26. When the valve 66 is in a second position water is divided between hoses 68 and 74, the water through hose 74 being directed through the lid 16 and the spout 22 to the container 48.

A water level switch 76, which may be of any type well known in the art, is mounted in control panel 14. The switch 76 is connected through an air chamber 78 to sump 45 provided at the bottom of the tub 24. As water accumulates in the sump, the air in the chamber 78 is compressed to close the switch 76. The water supply means described above is not part of the present invention and some elements thereof have been shown only generally in phantom in FIG. 1, while other elements have been omitted for the sake of simplicity.

A transmission 80 is mounted in an opening in the tub 24 and secured to the tub by a plurality of bolts 82. The transmission includes a collar 84 and the basket 26 is mounted on this collar in driving relationship with the transmission by a plurality of bolts 86 extending through a flange at the center of the basket and received in the collar 84. The basket 26 is driven through the transmission 80 by means of a reversible electrical motor 88. The motor 88 is connected to the transmission through a suitable load-limiting clutch 90 and a belt 92.

The electric motor 88 also drives a pump for discharging water from the sump 45 through a hose 96 to a suitable drain (not shown). The particular form of the pump is not important so long as the pump is capable of withdrawing liquid from the sump in response to rotation of the motor 88 in either direction.

Figure 2:
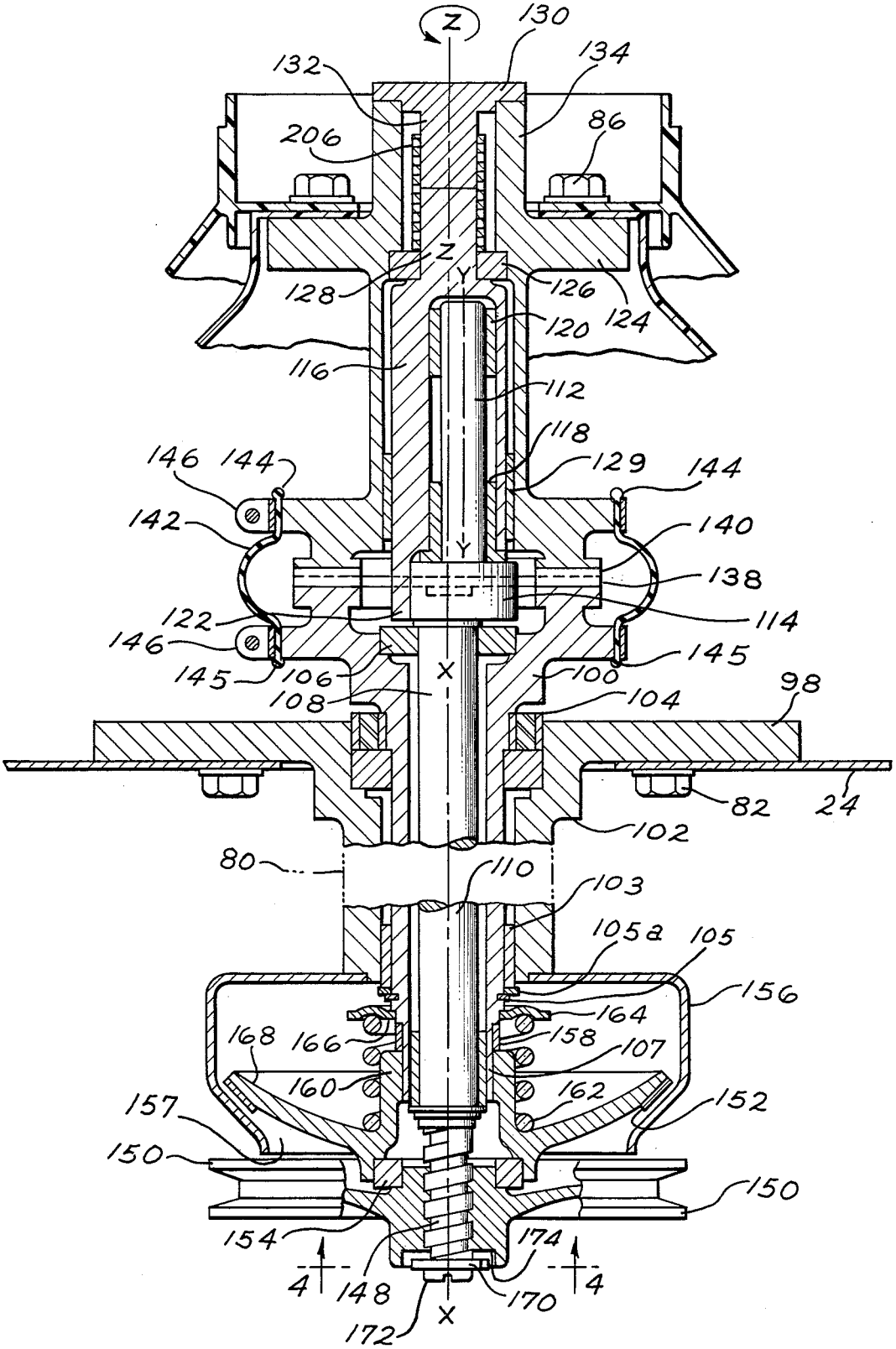
FIG. 2 is an enlarged sectional view of the transmission and brake mechanism of the washing machine shown in FIG. 1, the transmission being shown in the spin position wherein the axis of the basket is aligned with the axis of the input shaft of the transmission.
Figure 3:
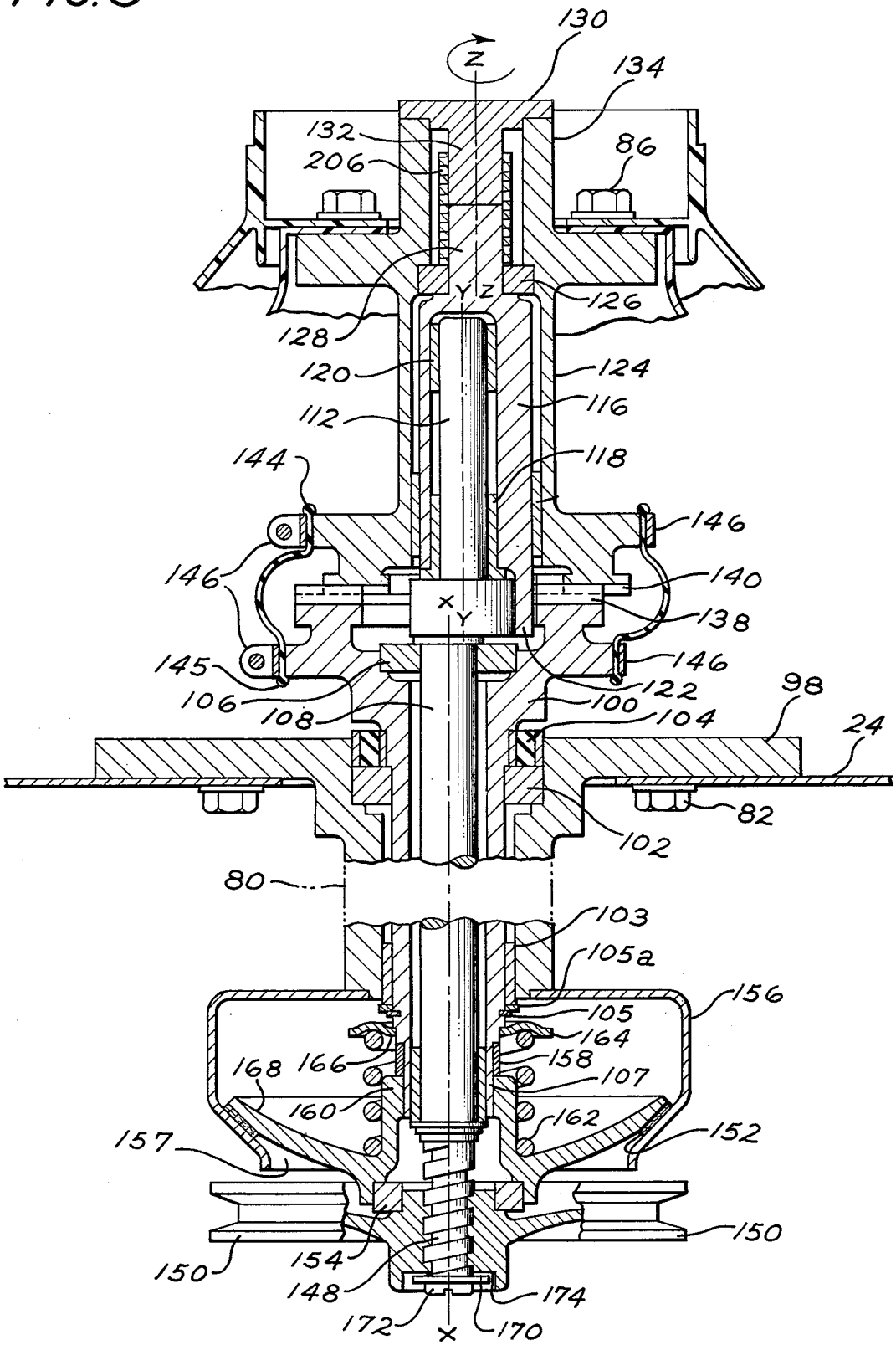
FIG. 3 is a view of similar to FIG. 2 but showing the transmission in the orbiting position wherein the axis of the basket is displaced from the axis of the input shaft of the transmission.

Referring now to FIGS. 2 and 3, details of the transmission and the mechanism of this invention are shown. Transmission 80 includes a hub 98 by which the transmission is mounted by means of the bolts 82 on the bottom of the tub 24. A spin tube 100 is mounted within the hub 98 by means of bearings 102 and 103. Bearing 102 is a ball bearing. Bearing 103 is a plain bearing of the lubricating type and is fixed to the hub 98. A seal 104 is provided adjacent the bearing 102. To prevent upward movement of the spin tube 100 and associated elements a snap ring 105 is arranged within a groove in the spin tube 100. A washer **105*a* is interposed between the bearing 103 and the snap ring 105. Mounted within the spin tube by means of bearings 106 and 107 is a crank 108, which also serves as the drive shaft of the transmission. The bearing 106 is a ball bearing. The bearing 107 is a plain bearing of the lubricated type and is fixed to the spin tube 100. The crank 108 includes a lower input shaft 110 and an upper shaft 112 offset from the lower input shaft 110, a collar 114 being formed between the lower shaft 110 and the upper shaft 112. The axis Y—Y of the upper shaft 112 is offset, as shown, from the axis X—X of the lower or input shaft 110**.

An eccentric 116 is mounted by means of sleeves 118 and 120 on the upper shaft 112 of the crank 108. The sleeve 118 rests on the collar 114 of the crank and a portion 122 of the eccentric extends partially around this collar. The eccentric 116 is received within the hub 124 of the basket 26. A ball bearing 126 is positioned between an upwardly extending end 128 of the eccentric and the basket hub 124, and a plain bearing 129 is positioned between the lower end of the eccentric 116 and the lower portion of the basket hub 124. The axis Z—Z of the upwardly extending end 128 of the eccentric 116 coincides with the axis of the basket 26. The eccentric, as can be seen by a comparison of FIGS. 2 and 3, is movable through 180° between the position shown in FIG. 2 wherein the axis Z—Z of the basket is aligned with the input end 110 of the crank or drive shaft 108 for the spin operation and the position shown in FIG. 3 where the axis Z—Z of the basket is offset from the axis X—X of the input end of the drive shaft so that the basket orbits about the axis X—X.

A member 130 having a downwardly extending cylindrical portion 132 corresponding in diameter to the upwardly extending end 128 of the eccentric 116 is secured to an upwardly extending portion 134 of the basket hub 124. In order to permit driving of the basket about its axis in the spin mode but to permit slippage of the basket relative to the eccentric 116 and the upwardly extending element 128 thereof during orbiting, a one-way clutch spring 206 is provided surrounding the downwardly extending cylindrical portion 132 and the upwardly extending element 128. This spring is of a type commonly referred to in the art as an L.G.S. spring and is operative to slip when a member to which it is mounted rotates in one direction but to lockably engage the member to which it is mounted when it rotates in the reverse direction. In the arrangement shown the clutch spring 206 slips when shaft 108 and the eccentric 116 are being driven in a clockwise direction, as shown in FIG. 3, so that these elements may move relative to the basket which at that time is being held against rotation about its axis. When the shaft 108 and the eccentric 116 are rotated in a counterclockwise direction, as shown in FIG. 2 the clutch spring 206 engages the upwardly extending element 128 of the eccentric and the downwardly extending cylindrical element 132, which is fixed to the basket hub, so that the basket is driven in a counterclockwise direction about its axis.

In order to permit movement of the eccentric 116 and hence to permit movement of the axis of the basket hub and the basket relative to the axis of the input end of the drive shaft of crank 108, the basket hub 124 and the spin tube 100 are connected by a coupling of the type known as an Oldham coupling. Since this coupling is well known in the art it has not been shown in detail. However, as can be seen by a comparison of FIGS. 2 and 3, it includes a lower plate 138, a center plate 139 and an upper plate 140 to permit shifting of the basket hub between the positions shown in FIGS. 2 and 3. An Oldham coupling suitable for use in the transmission of the present application is illustrated and described in more detail in the aforementioned Bochan application.

In order to seal the area between the lower end of the basket hub 124 and the spin tube 100 an annular flexible boot 142 is provided. The boot 142 is formed to include a bead 144 and 145 at the top and at the bottom respectively. A ring clamp 146 is provided at the upper end of the boot below the bead 144 for clamping the upper end of the boot in sealing relationship against the basket hub 124. A similar ring clamp 147 is provided at the lower end of the boot above the bead 145 for clamping the lower end of the boot in sealing relationship against the spin tube 100.

The drive shaft or crank 108 is arranged to be driven in a clockwise direction, viewed from the top, for orbiting the basket in a clockwise direction during the washing and rinsing operations, as shown in FIG. 3, and is arranged to be driven in a counterclockwise direction, as shown in FIG. 2, for rotating the basket abouts its axis in a counterclockwise direction during the spin or centrifugal extraction operation. The washing machine disclosed in this application is arranged, as described above, so that the basket axis Z—Z is offset from axis X—X of the input end 110 of the drive shaft during the washing and rinsing operations and the basket orbits about the axis of the input end of the drive shaft or crank 108. On the other hand, the basket is arranged to have its axis Z—Z aligned with the axis X—X of the input end of the drive shaft during the spin operation illustrated in FIG. 2. It is necessary that the basket be prevented from rotating about its own axis during the washing and rinsing operations; conversely it is necessary that the basket be able to rotate about its own axis during the spin operation in order to effect centrifugal extraction of water from the fabrics in the basket.

Since the details of the structure for shifting the eccentric between two positions 180° apart to effect driving of the basket in either the orbiting mode or the spin mode are not part of the present invention, such details of this part of the transmission have not been shown. The structure for disposing the eccentric in its two alternate positions described in the section headed "Alternate Transmission" in the aforementioned Bochan application and illustrated in FIGS. 8 and 9 thereof may be employed in the washing machine of the present invention. However, in accordance with the present invention the crank and eccentric mechanism is inverted from that shown in the Bochan application; that is, in the present application the eccentric is positioned on the upper shaft of the crank rather than on the lower shaft. This inversion reduces to some extent the bulk of the mechanism which is shifted and which orbits about the input shaft and thereby permits the use of somewhat smaller and less expensive bearings. Moreover, the provision for vertical movement incorporated in the Bochan structure is not utilized in the structure of the present invention. The vertical movement in the Bochan apparatus is employed to effect release and engagement of the brake, and this is not required in the structure of the present invention, because, as described herein, a different and simpler braking arrangement is employed.

In accordance with the present invention a simplified structure is provided for automatically restraining the basket against motion about its own axis when operating in the orbiting mode and for freeing the basket for rotation about is own axis when operating in the spin or centrifugal extraction mode. In accordance with this invention the lower or input shaft 110 of the crank 108 is provided with a helical groove 148, and a pulley 150, driven by the belt 92, has a cooperating internal helical groove in the hub thereof. The pulley is mounted on the helical groove 148 so that when rotated in one direction it rides up the helical groove and when rotated in the opposite direction it rides down the helical groove. A brake shoe 152 is mounted on the pulley by means of a ball bearing 154 interposed between the pulley and the brake shoe. The brake shoe 152 is positioned within a stationary brake housing 156 which is mounted in fixed position on the transmission hub 98 and disposed adjacent the lower end of the drive shaft. The brake housing 156 is of annular shape and includes an open lower end 157 so that wear debris resulting from braking may fall harmlessly through this open end without fouling other parts of the mechanism. The brake shoe 152 is arranged for axial motion, that is up and down motion as viewed in FIGS. 2 and 3, by means of a spline 158 formed at the lower end of the spin tube 100; the spline 158 is engaged by an internal spline formed in the hub 160 of the brake shoe. The brake shoe 152 is biased toward its lower position, wherein it engages a braking surface internal of the brake housing 156 and prevents rotation of the basket, by a coil compression spring 162 which surrounds the hub 160 of the brake shoe. A stop ring 164 is provided for engagement by the upper end of the coil spring 162. Upward movement of the stop ring 164 is prevented by engagement of the stop ring with a shoulder 166 on the spin tube 100. The lower end of the coil spring 162 engages a wall 168 of the brake shoe to urge the brake shoe toward its lower position in which it engages the brake housing 156. A stop member or washer 170 is secured to the lower end of the shaft 108 by means of a screw 172 received in a threaded recess in the lower end of the input shaft 110 in order to limit the downward movement of the pulley during clockwise rotation.

In order to stop rotation of the pulley 150 relative to the input shaft 110 before the pulley "bottoms" on the stop washer 170, the structure shown in FIG. 4 is provided. As shown in that figure, the stop washer 170 includes a radially extending tab 171, and the hub of the pulley 150 includes an inwardly extending rib 173. The tab 171 engages the rib 173 before the pulley can move downwardly along the helical groove 148 a sufficient distance for the portion 174 of the hub to engage the upper face of the stop washer 170. Such engagement could involve high impact forces and potential wedging action. The engaging portions of the stop washer and the lower end of the input shaft 110 are formed so as to prevent relative rotation of the washer and the shaft. In the form shown in FIG. 4, this is accomplished by forming the shaft and the central aperture of the washer of non-circular cross section. Other arrangements, such as cooperating splines, could be employed, if desired.

The operation of the brake releasing and engaging mechanism of this invention is as follows. As explained previously, the motor 88 is a reversible electric motor. It is arranged to drive the shaft or crank 108 in a clockwise direction, as shown in FIG. 3, for providing orbiting motion of the basket about the axis X—X during the wash and rinse operations. It is arranged, when reversed, to drive the drive shaft or crank 108 in a counterclockwise direction, as shown in FIG. 2, during the spin or centrifugal extraction operation. As shown in FIG. 2, when the pulley 150 is driven in a counterclockwise direction for operation of the washing machine in the spin mode, it rides up the helical groove 148. This upward movement of the pulley moves the brake shoe 152 upwardly along the spline 158 against the bias of the spring 162, positioning the brake shoe 152 out of engagement with the brake housing 156, as shown in FIG. 2. The basket 26 is positioned with its axis Z—Z in alignment with the axis X—X of the input shaft 110 and the basket is free to rotate about its axis to effect the spin or centrifugal extraction operation.

When the spin operation is completed the bias of the spring 162 causes the brake shoe 152 to be moved downwardly into engagement with the brake housing 156, stopping rotation of the basket 26. This movement of the brake shoe causes the pulley to be moved downwardly to its lower position shown in FIG. 3. When it is desired to operate the washing machine in the orbiting mode for the wash or rinse operation, the motor is reversed to drive the pulley 150 and the shaft 108 in a clockwise direction. As shown in FIG. 3 this causes the axis of the Z—Z of the basket to be offset from the axis X—X of the lower or input shaft 110. When the pulley is driven in this clockwise direction its downward movement is limited by engagement of the tab 171 and the rib 173. The brake shoe 144 having been moved downwardly into engagement with the brake housing 156 by the spring 162, the basket 26 is held against rotation about its axis as it orbits about the axis X—X of the input shaft.

In the arrangement of this invention the operation to effect release and engagement of the brake requires upward and downward movement only of the pulley 150 and brake shoe 152, which are elements of relatively small mass. No upward and downward movement of heavier elements, such as the basket and its contents or portions of the transmission, is required, thus further simplifying the construction and operation of the washing machine. Moreover, the brake shoe is moved to its engaging position by the spring 162, and the actuation of the brake is, therefore, not dependent on the weight of the basket and downward movement of the basket and its contents.

Further the braking apparatus of this invention is positioned at the lower end of the transmission 80, so that it is easily accessible for any necessary maintenance or repair without requiring major disassembly of components of the transmission.

Also, the braking apparatus is disposed remote from the Oldham coupling and the surrounding boot 142. This permits utilization of a smaller boot 142 in the region of the coupling than would otherwise be possible, and this in turn makes possible greater radial flexibility of the boot.

Finally, any wear debris developing from operation of the brake can fall harmlessly out through the open bottom of the brake housing 156 without fouling up other parts of the mechanism.

While a specific embodiment of this has been illustrated and described, modifications may be made in the particular structure shown and described without departing from the invention. It is intended, therefore, by the appended claims to cover all such modifications as come within the spirit and scope of this invention.

I claim:

1. A washing machine for fabric articles comprising:

(a) a receptacle for receiving the fabric articles, said receptacle being mounted on a drive shaft in a substantially upright position and having a substantially vertical axis;

(b) drive means for said drive shaft rotatable in a first direction for rotating said receptacle about its axis;

(c) said drive means being rotatable in a second direction for effecting orbital movement of said receptacle about a second axis spaced from said receptacle axis;

(d) brake means for preventing rotation of said receptacle about its axis during said orbital movement of said receptacle; and (e) biasing means for biasing said brake means toward its braking position;

(f) said drive shaft including a helical groove;

(g) said drive means including a drive member engaging said helical groove and engaging said brake means whereby rotation of said drive means in said first direction causes said drive member to move said brake means away from its braking position to permit rotation of said basket about its axis;

(h) said biasing means moving said brake means to its braking position upon discontinuance of rotation of said drive means in said first direction.

2. The washing machine of claim 1 wherein said brake means is disposed adjacent the lower end of said drive shaft thereby making said brake means easily accessible for maintenance and repair.

3. The washing machine of claim 1 wherein said drive member comprises a pulley engaging said helical groove.

4. The washing machine of claim 3 wherein:

(a) a stop member is mounted on said drive shaft adjacent the lower end of said helical groove;

(b) said stop member includes a radially extending tab; and (c) said pulley includes a rib on the hub thereof engageable with said tab for limiting downward movement of said pulley along said helical groove during rotation of said drive means in said second direction.

5. The washing machine of claim 1 wherein:

(a) said brake means includes a brake shoe;

(b) said biasing means comprises a compression spring surrounding said shaft, one end of said spring engaging said brake shoe; and (c) a stop element engaging the other end of said spring.

6. The washing machine of claim 5 wherein:

(a) said washing machine includes a stationary tub within which said receptacle is positioned;

(b) said brake means includes a brake housing supported from said tub and having a braking surface thereon; and (c) said brake shoe engages said braking surface for preventing rotation of said receptacle about its axis.

7. The washing machine of claim 6 wherein:

(a) said brake housing is disposed adjacent the lower end of said drive shaft;

(b) said braking surface is internal of said housing; and (c) said brake housing includes an open lower end whereby wear debris from braking action is discharged through said open end without fouling other parts of the mechanism.

8. The washing machine of claim 5 wherein:

(a) a spin tube surrounds said drive shaft;

(b) said receptacle is supported by said spin tube;

(c) said spin tube has a spline formed thereon; and (d) said brake shoe is mounted on said spline for axial movement between braking and non-braking positions.

9. The washing machine of claim 8 wherein said stop element is positioned on said spin tube.

10. The washing machine of claim 8 wherein:

(a) said basket includes a depending hub;

(b) an Oldham coupling between the lower end of said hub and the upper end of said spin tube;

(c) a flexible boot connected to said hub and said spin tube outwardly of said coupling;

(d) said brake means being disposed at the lower end of said spin tube remote from said coupling and said boot.

11. The washing machine of claim 1 wherein:

(a) said drive shaft comprises a crank including a lower input shaft and an upper shaft offset from said lower input shaft; and (b) an eccentric mounted on said upper shaft for shifting the axis of said basket between a first position aligned with the axis of said input shaft and a second position offset from the axis of said input shaft.

* * * * *